US005216190A

United States Patent [19]

Tanaka et al.

[11] Patent Number: 5,216,190

[45] Date of Patent: Jun. 1, 1993

[54] LOCKED TRIGGER RELEASING DEVICE

[75] Inventors: Shinpei Tanaka; Nobuya Kurohara, both of Kohchi, Japan

[73] Assignee: Kabushiki Kaisha Miroku Seisakusho, Japan

[21] Appl. No.: 848,892

[22] Filed: Mar. 10, 1992

[30] Foreign Application Priority Data

May 30, 1991 [JP] Japan ..... 3-127293

[51] Int. Cl.[5] ..... F41A 17/48; F41A 19/24

[52] U.S. Cl. ..... 42/69.02; 42/DIG. 1

[58] Field of Search ..... 42/DIG. 1, 69.02

[56] References Cited

U.S. PATENT DOCUMENTS

| | | | |
|---|---|---|---|
| 2,976,637 | 3/1961 | Robinson, Jr. et al. | 42/70.06 |
| 3,196,747 | 7/1965 | Gallagher et al. | 42/69.02 |
| 3,983,654 | 10/1976 | Vironda | 42/69.02 |
| 4,026,056 | 5/1977 | Roman | 42/DIG. 1 |
| 4,499,684 | 2/1985 | Repa | 42/69.01 |
| 4,625,444 | 12/1986 | Beretta | 42/69.02 |
| 4,662,098 | 5/1987 | Timari | 42/69.02 |
| 4,897,951 | 2/1990 | Osborne | 42/69.02 |

FOREIGN PATENT DOCUMENTS

| | | |
|---|---|---|
| 0165334 | 6/1984 | European Pat. Off. . |
| 2431110 | 2/1985 | France . |
| 285422 | 6/1928 | United Kingdom . |

*Primary Examiner*—David H. Brown

*Attorney, Agent, or Firm*—Lowe, Price, LeBlanc & Becker

[57] ABSTRACT

A device, for releasing a locked trigger set by a set-trigger mechanism in a gun having a receiver, a bolt loosely inserted in the receiver, and a bolt handle for rotating and reciprocating the bolt so as to load a bullet and set in a fire-enabling state, includes an abutting portion formed on the bolt handle, and a release link positioned for contact with the abutting portion and a trigger in accordance with a rotational movement of the bolt handle. The trigger locked by the set-trigger mechanism is released when the bolt handle is rotated up to a fire-disabling position, causing the abutting portion to push the release link against the trigger to unlock it. With this construction above, when the bolt handle is in the fire-disabling state, the trigger can never be in the locked position, which enables a safe and secure release of the locked trigger and safe bullet loading and/or removal.

9 Claims, 6 Drawing Sheets

LOCKED TRIGGER RELEASING DEVICE

BACKGROUND OF THE INVENTION

1. Field of the Invention

The present invention relates to a set-trigger mechanism applied to a gun such as a rifle, and specially to a releasing device for safely and securely releasing a trigger locked by the set-trigger mechanism.

2. Description of the Prior Art

Generally in firing with live bullets, it is not easy to obtain a best timing for discharging, since the sighting of a target by a gun being held by a shooter is not easily stabilized due to a balance of the gun itself, variation of the shooting condition such as a wind and so on, and in order to solve this problem, a so-called set-trigger mechanism has been developed so far, thereby to enable a firing of a gun even with a very subtle feathery touch to the trigger.

FIGS. 5 and 6 each shows a conventionally adopted set-trigger mechanism, and here a mechanism of the trigger itself is first explained as follows.

In these figures, reference numeral 1 denotes a receiver where the loading of a bullet into a barrel cartridge chamber (not shown) and removal of a bullet or an empty cartridge case therefrom are conducted. Reference numeral 2 denotes a bolt which is assembled together with a bolt handle 3 and a bolt shroud 4, and is rotated and reciprocated within the receiver 1 in accordance with an operation of the bolt handle 3 so that a bullet is loaded into the barrel cartridge chamber and set in a fire-enabling condition.

Reference numeral 5 denotes a firing pin shirr having at an opposite end thereof a firing pin which is protruding from a far end of the bolt 2. This firing pin shirr 5 is repulsively urged toward a nuzzle side of the gun (left side of the figure) by a spring (not shown) when it is set in a fire-enabling state, and a protruding portion 6*a* of a shirr 6 is engaged with a slanting portion 5*a* formed on the firing pin shirr 5.

The shirr 6 is rotatably supported by a shaft 6*b* formed at the left side thereof, and is also formed with another protruding portion 6*c* at its lower side. This protruding portion 6*c* loosely enters into a dented portion 7*a* of a trigger shirr 7 so as to hamper the protruding portion 6*a* from shifting its position downwardly, and thus hampering the firing pin shirr 5 from moving toward left side of the figure. The trigger shirr 7 is rotatable on an axis 8.

Reference numeral 9 denotes a trigger which is also rotatable on the axis 8, and when this trigger is pulled, it is rotated in a counterclockwise direction, so that a head portion 9*a* thereof pushes the upper portion of the trigger shirr 7 toward left side of the figure, disengaging the dented portion 7*a* from the protruding portion 6*c* to permit the shirr 6 to rotate in a clockwise direction, and then the slanting portion 5*a* goes over the protruding portion 6*a* and the firing pin shirr 5 instantly moves toward left to discharge a bullet.

A bullet is discharged from a gun by all these above movements. However, the trigger 9 should be pulled by a substantially large force in this case, and therefore it is not easy to get the best timing for discharging as mentioned before. With this background, a set-trigger mechanism has been developed, the mechanism of which is now explained hereinafter.

In FIGS. 5 and 6, reference numeral 10 denotes a roller arm rotatable on an axis 10*a* and having a roller 11 at an end portion thereof, and this roller arm 10 is repulsively urged in a counterclockwise direction by a spring 12. On the other hand, the trigger 9 is formed with a projection 9*b* having a sharpened point at its top end. When the trigger 9 is rotated in the opposite direction to that for discharging a bullet, that is, rotated in a clockwise direction, a set adjustment screw 13 is adjusted to lock the sharpened point of the projection 9*b* in an upper position than a line connecting the respective center points of the roller 11 and the axis 8, and by this adjustment, the trigger is locked by the set-trigger mechanism.

By lightly pulling the thus locked trigger 9 as shown in FIG. 6, the following actions are instantly done to discharge a loaded bullet. First, the projection 9*b* abruptly slides downward along the outer periphery of the roller 11 due to the repulsively urged force of the spring 12, the trigger 9 is thereby rotated in a counterclockwise direction, the head portion 9*a* thereof hits the trigger shirr 7 in the left ward direction, and then the dented portion 7*a* and the protruding portion 6*c* are disengaged from each other so as to discharge. In this case, since the projection 9*b* is formed with a sharpened point and is situated on the outer periphery of the roller 11, a conception that we conventionally had "to draw a trigger" is changed to "to touch a trigger", and thereby to greatly contribute to an improvement of a shooting technique.

However, since the above set-trigger mechanism is, as a matter of fact, performed in a state that a bullet is loaded and is enabled to discharge, once the trigger is locked by the set-trigger mechanism, the bullet is possibly discharged even by a very light feather-like impact. For example, if the bolt handle 3 is abruptly closed and operated, the trigger can easily be brought into a fire-enabling state, and therefore, once the trigger is locked, it should be treated with a meticulous attention.

In the above case, if the bullet is not discharged and still remains in the loaded state, the locked trigger should be released. However, if the releasing operation is not conducted with care, a sudden discharge of the bullet would accidentally occur, and therefore, in order to avoid this accidental phenomenon, the locked trigger should be firmly pressed first and put back up to the released position before moving the nuzzle of the gun away from the target, which requires a meticulous attention of the users.

SUMMARY OF THE INVENTION

The present invention has been made to eliminate such problems as described above, and it is an object of the present invention to provide a locked trigger releasing device for safely and securely releasing a trigger locked by a set-trigger mechanism.

In order to attain the above object, the present invention provides a locked trigger releasing device for releasing a trigger locked by a set-trigger mechanism widely applied to a gun which comprises at least a receiver, a bolt loosely inserted in the receiver, and a bolt handle for rotating and reciprocating the bolt so as to load a bullet and set in a fire-enabling state, wherein the locked trigger releasing device comprises: an abutting portion formed on the bolt handle, and a release means having a release link and capable of being brought into contact with the abutting portion and pushed down toward a trigger in accordance with a rotational movement of the bolt handle, characterized in that the trigger locked by the set-trigger mechanism is released when the bolt handle is rotated up to a fire-disabling position, at which the abutting portion is brought into abutment with the release means thereby to urge the release means to push the trigger. By the way, the locked trigger releasing device can be constructed such that the release means further comprises a release lever attached to the release link, and/or a spring means to repulsively urge the release link toward an upper end thereof.

For releasing a trigger locked by the above set-trigger mechanism, first of all, rotate the bolt handle 3 from the state shown in FIG. 1 in counterclockwise direction. When the bolt handle 3 is rotated and comes to a fire-disabling point, an abutting portion 26 formed on the bolt handle 3 is brought into abutment with the release link 21 as shown in FIG. 2. When the bolt handle 3 is further rotated, the abutting portion 26 forces the release link 21 to move downward and an attachment 22 attached to the release link 21 pushes the trigger 9, so that the trigger is released. from its locked position. Here, although the trigger 9 is rotated to the fire-enabling direction, discharging of a bullet dose not occur since the bolt handle 3 has already come to a fire-disabling point before this movement of the trigger, which thus enables a safe and secure release of the locked trigger.

Other objects and features of the invention will be more fully understood from the following detailed description and appended claims when taken in conjunction with the accompanying drawings.

Figure 1:
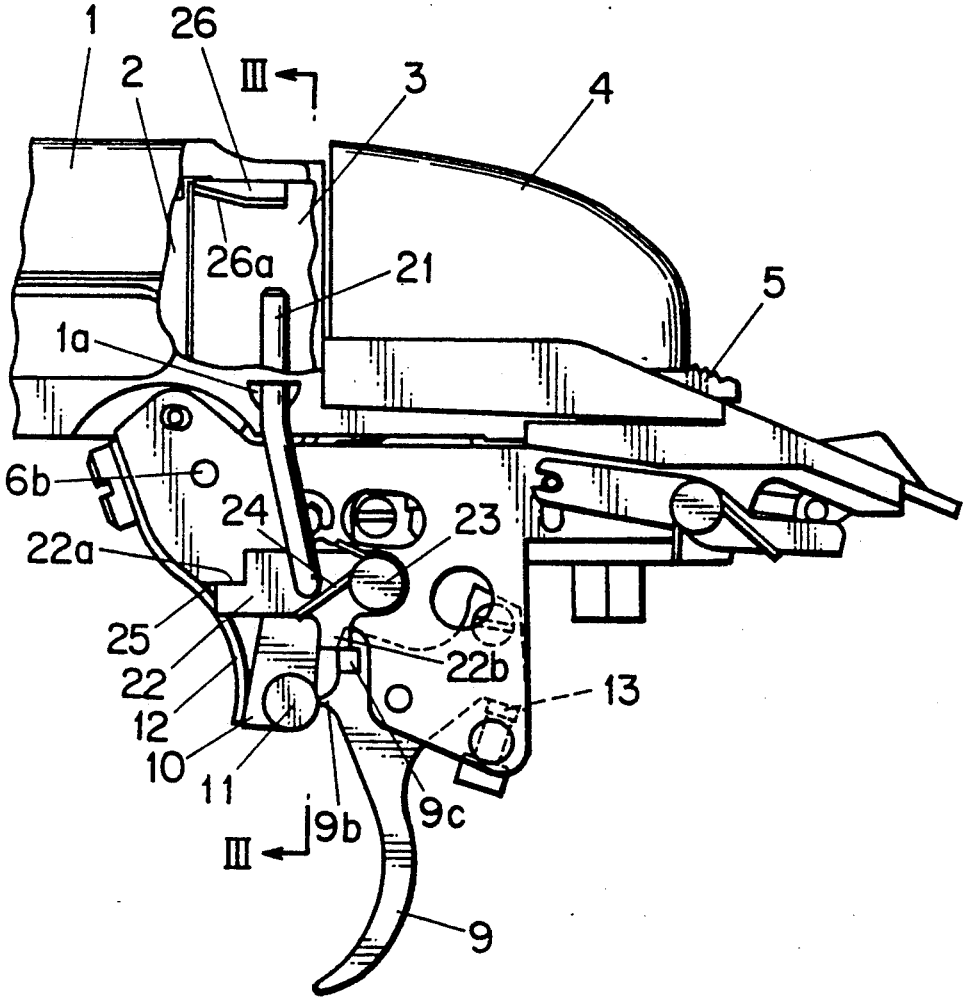
FIG. 1 is an illustration showing a release mechanism according to one embodiment of the present invention, in which a trigger is in a locked state.

In the figures, reference numeral 1 denotes a receiver, numeral 2 denotes a bolt, 3 a bolt handle, 9 a trigger, 11 a roller, 21 a release link, 22 an attachment attached to the release link 21, 24 a spring means, 26 an abutting portion, and numeral **26*a*** denotes a guide means.

DETAILED DESCRIPTION OF THE PREFERRED EMBODIMENT

Figure 2:
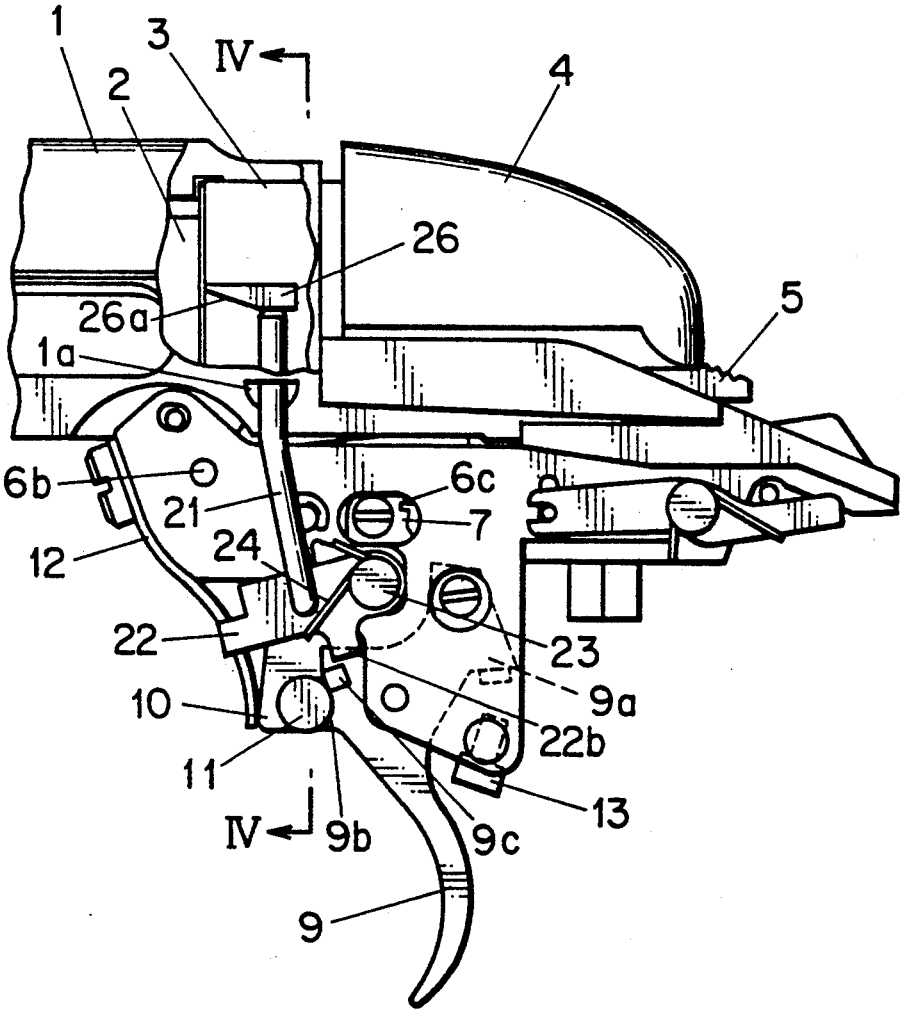
FIG. 2 is an illustration showing the same release mechanism as FIG. 1, in which the trigger is in a released state.

FIGS. 1 and 2 each shows one embodiment of the present invention, wherein FIG. 1 illustrates a state that a trigger is locked by a set-trigger mechanism, and FIG. 2 illustrates a state that the trigger is released from its locked position. The locked trigger releasing device according to the present invention is an additional mechanism added to the conventional set-trigger mechanism, and therefore most of the parts shown in the figures are same as those of the conventional mechanism. With this reason, an explanation given hereinafter is principally about a difference between the conventional mechanism and that of the present invention.

A receiver 1 is formed with a through-hole **1*a*, through which a release link 21 penetrates at a substantially right angle to the axis of a bolt 2. The release link 21 is a cylindrical metal product, the upper end portion of which intrudes into the receiver 1, the middle portion thereof is loosely bent toward the trigger 9, and further the lower portion thereof is bent at right angle to the surface of FIGS. 1 or 2 so as to be finally brought into contact with a release lever 22 which is an attachment attached to the release link 21**.

The release lever 22 is rotatable on a rotational shaft 23, and is repulsively urged in a clockwise direction by a spring means 24 provided to the rotational shaft 23, and therefore, the release link 21 is also urged toward its upper end portion by the spring means 24. In addition, a latching portion **22*a* of the release lever 22 is abutted to an end surface of a base plate 25 of the trigger mechanism, thereby to put a limit for preventing the release link 21 from moving upwards. The release lever 22 is formed with a projection 22*b* at its lower portion, and this projection 22*b* is substantially abutted to a projection 9*c* formed on the trigger 9. On the other hand, the bolt handle 3 is formed with an abutting portion 26 which is protruding therefrom, and is further formed with a guide portion 26*a*** at its left side in a slanting form.

Figure 3:
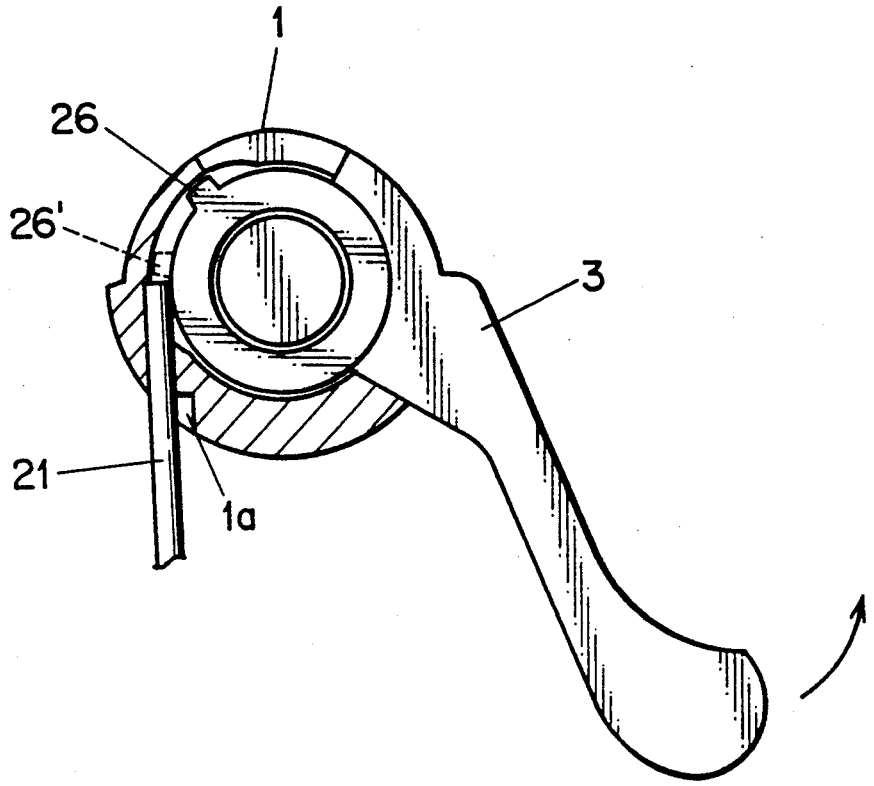
FIG. 3 is a sectional view cut along the line III—III of FIG. 1, in which the gun is in a fire-enabling state.

FIG. 3 is a sectional surface view cut along with III—III of FIG. 1, and illustrates that the bolt 3 is located in a fire-enabling state. In this situation, the abutting portion 26 is situated with a certain distance from the upper end portion of the release link 21, wherein even a very light touch to the trigger 9 could cause a discharging of a bullet.

Figure 4:
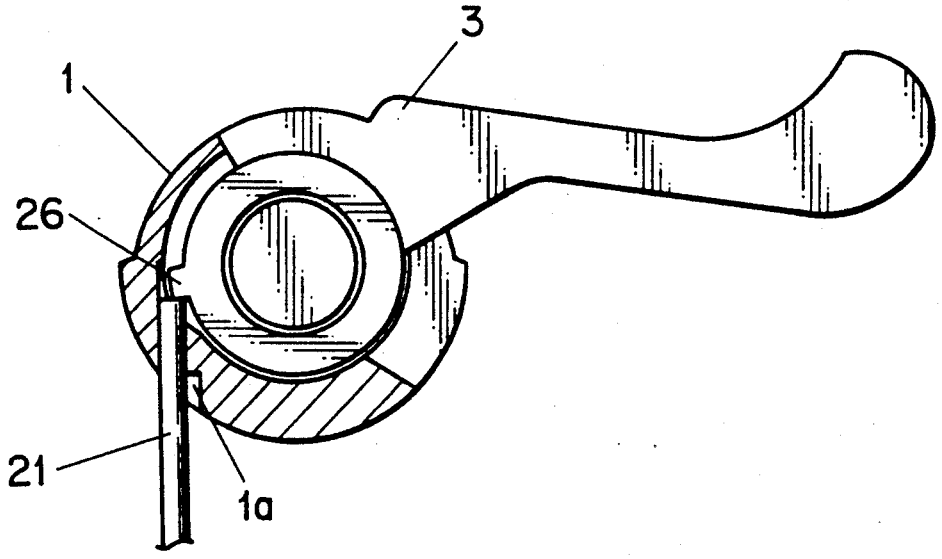
FIG. 4 is a sectional view cut along with IV—IV of FIG. 2, in which the gun is in a fire-disabling state.
Figure 5:
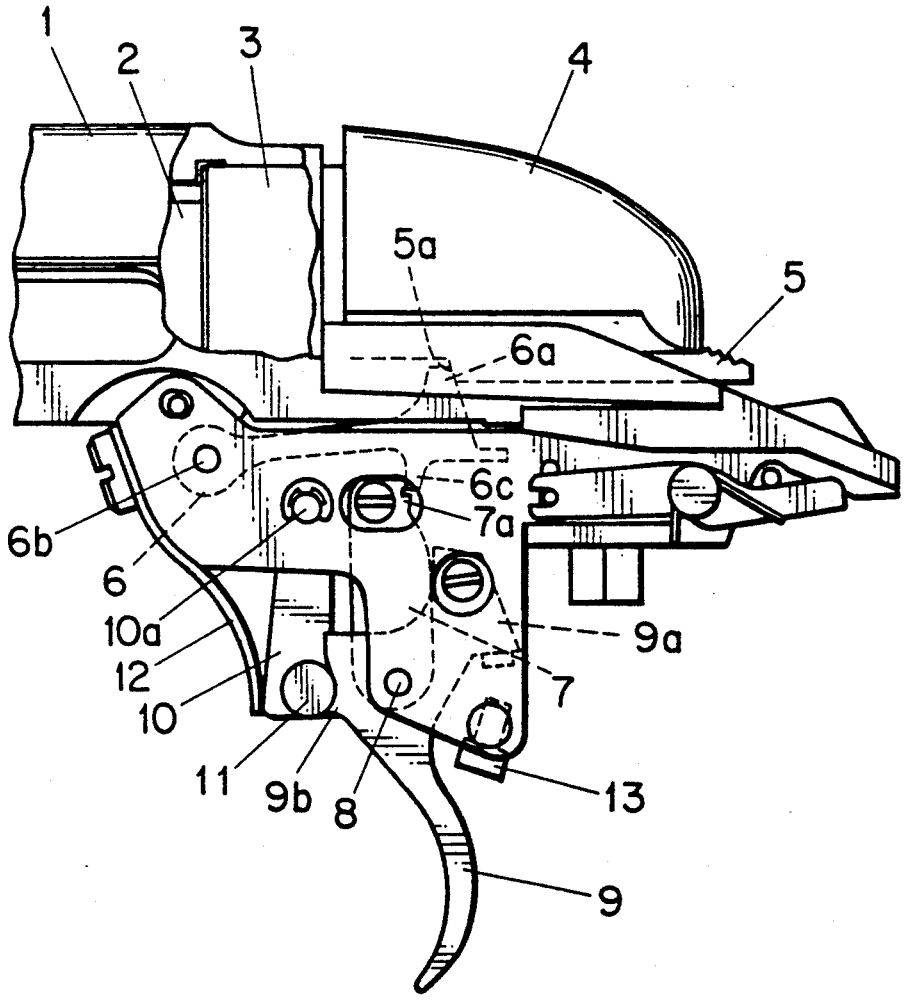
FIG. 5 PRIOR ART
FIG. 5 is an illustration showing a conventional set-trigger mechanism, in which a trigger is not in a locked state.
Figure 6:
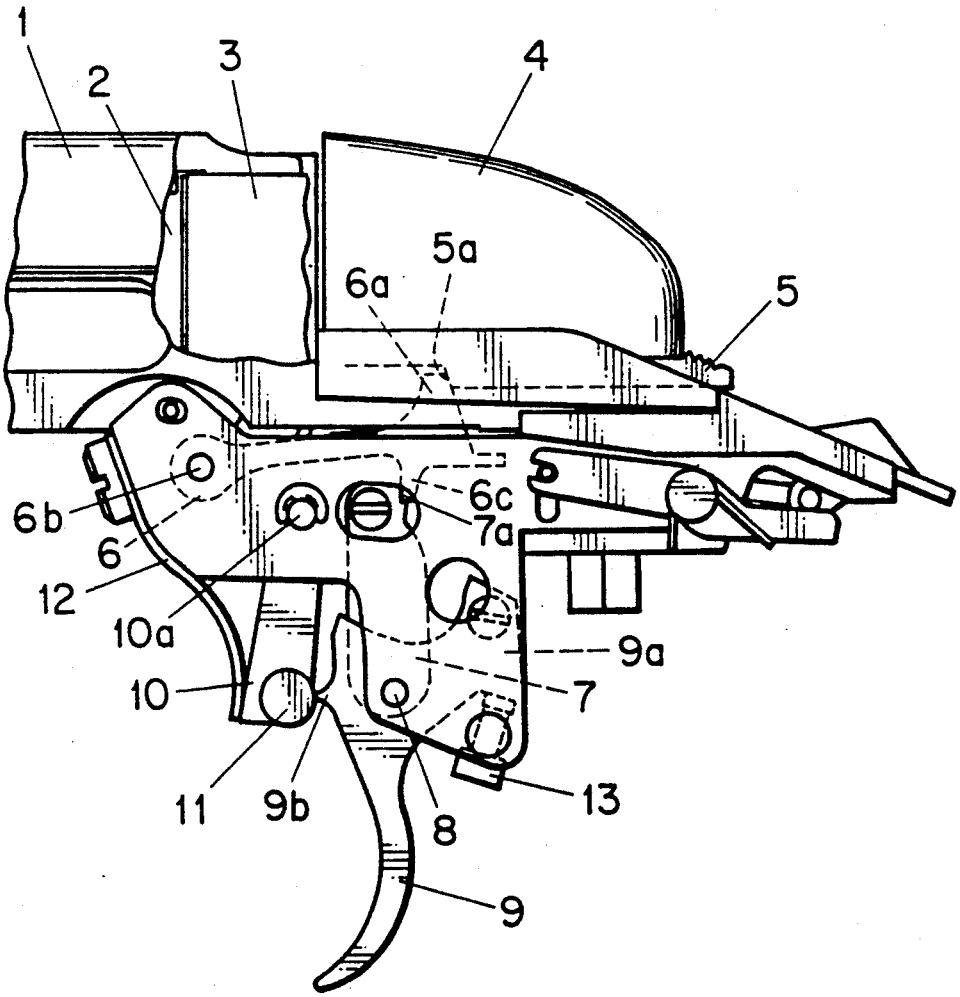
FIG. 6 PRIOR ART
FIG. 6 is an illustration showing the same set-trigger mechanism as FIG. 5, in which a trigger is in a locked state.

In the above situation, for releasing the trigger locked by the set-trigger mechanism, first of all, rotate the bolt handle 3 from the state shown in FIG. 3 in a counterclockwise direction. This rotation is a reverse movement to that for loading a bullet in a gun and put it in a fire-enabling state. When the bolt handle 3 is rotated and the abutting portion 26 thereof comes to a point 26' indicated by a broken line, the gun is put in a fire-disabling state. When the bolt handle 3 is further rotated in a counterclockwise direction as shown in FIG. 4, the abutting portion 26 pushes the upper end portion of the release link 21, and the release link 21 is thus moved to the lower direction against the force repulsively urged thereto by the spring means 24. Whereafter, the release lever 22 is, as shown in FIGS. 1 and 2, rotated in a counterclockwise direction, and the projection **22*b* thereof pushes the projection 9*c* of the trigger 9 downward, so that the trigger is finally situated in the position as shown in FIG. 2 which is called the released position of the trigger. By the way, the trigger 9 at this stage is shifted to the same direction as the fire-enabling direction, but since the bolt handle 3** has already been rotated and situated in a fire-disabling position, there is no possibility of danger such as a spontaneous discharge at all.

The position of the bolt handle 3 in FIG. 4 is the position in which a discharging mechanism is disabled, and also the position in which a bullet can be loaded into or taken out of the barrel cartridge chamber by way of the receiver 1. Subsequently, if the bolt 2 is retreated from the position of FIG. 4, the loaded bullet can be taken out of the barrel cartridge chamber by way of the receiver 1, whereby a bullet which has not been discharged yet can be taken out.

By the way, when the bolt 2 is retreated, the release link 21 goes up to the position as shown in FIG. 3 due to the force urged by the spring means 24, and thereafter, when the bolt 2 is to be inserted again, the abutting portion 26 thereof is abutted to the release link 21 and this is the reason why the further insertion of the bolt is hampered, and therefore the abutting portion 26 is formed with a guide portion 26*a* in a slanting form so that the bolt 2 can be smoothly closed by pushing the release link 21 downward. In fact, pushing the release link 21 downward here means the fact that even if the trigger 9 is in a locked state for discharging in that moment, the locked trigger is securely released when a bullet is to be loaded in or taken out of the barrel cartridge chamber by way of the receiver 1. In other words, when the bolt handle 3 is put in the fire-disabling state, the locking operation of the trigger is hampered, that is, it can be done only when the bolt handle 3 is in the fire-enabling state.

Figure 7:
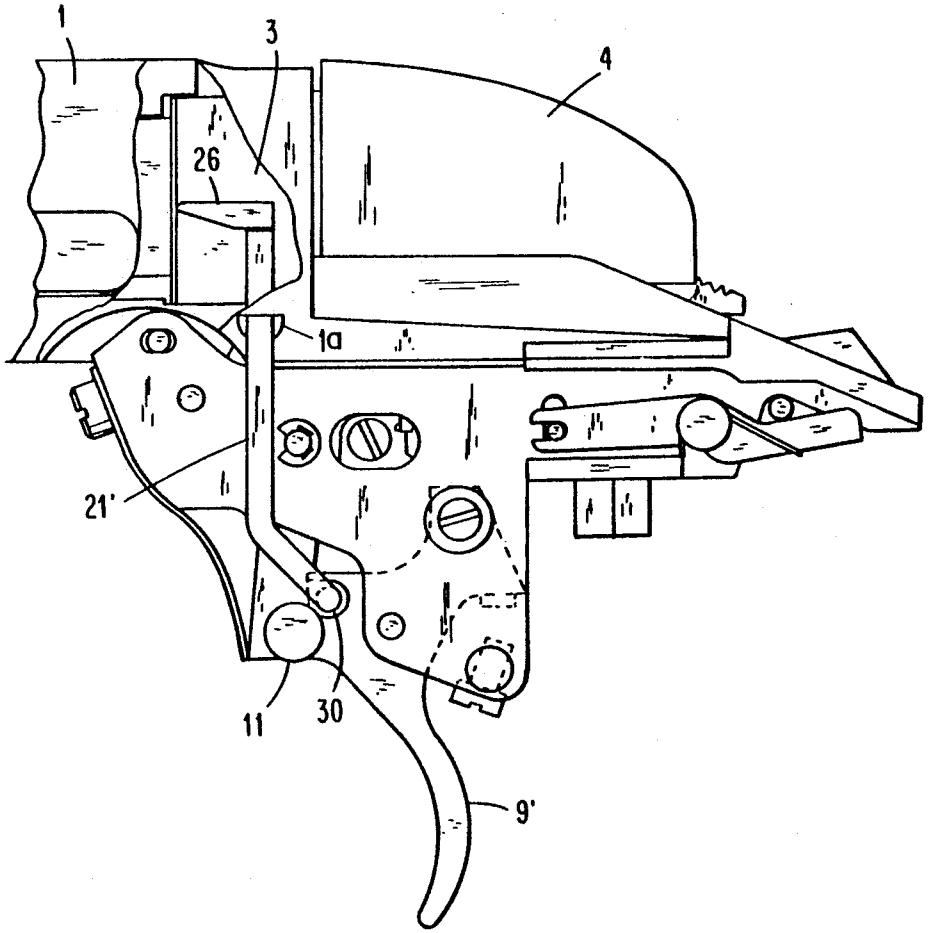
FIG. 7 is an illustration showing a release mechanism according to a second embodiment of the present invention, in which the trigger is in a released state.
Figure 8:
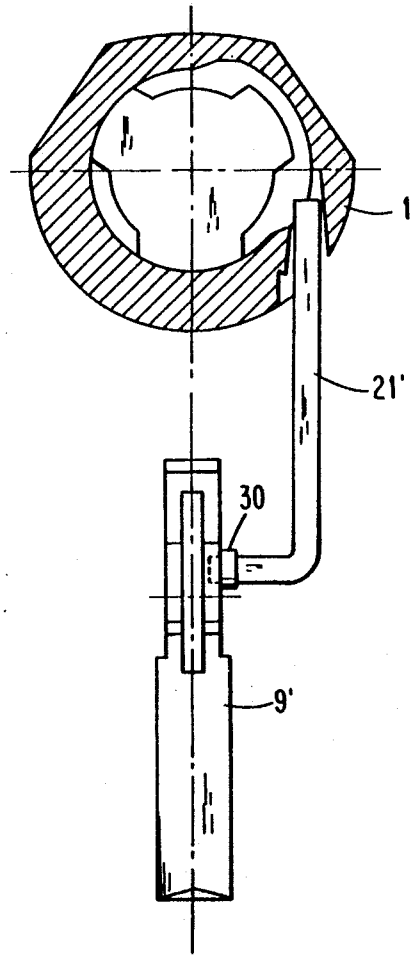
FIG. 8 is a sectional view of the receiver with components of the second embodiment.

The present invention can be variably constructed such as eliminating the release lever 22 so that the release link 21 directly pushes the trigger 9, eliminating the spring means 24 and so on, provided that it includes the mechanism in which the bolt handle can detect the rotated position thereof to put it in a fire-disabling position and push the locked trigger 9 downward so as to unlock the trigger from its locked state. FIGS. 7 and 8 illustrate the embodiment of the invention that eliminates the release lever 22. As can be seen from FIG. 7, the release 21' is directly connected at reference numeral 30 to the trigger 9'. The movement of the release link 21' is similar to the movement described for release link 21 in FIGS. 2–4. That is, the abutting portion 26 pushes the upper end portion of the release link 21', the link 21' pushing the trigger 9' downwardly at reference numeral 30 to the released position as shown in FIG. 7.

FIG. 8 more clearly illustrates the L-shaped configuration of the release link 21' to permit the release link 21' to directly push the trigger 9'.

Effect of the Invention

In summary, the present invention provides a locked trigger releasing device which is capable of releasing a trigger locked by a set-trigger mechanism safety and securely.

Furthermore, if the locked trigger releasing device according to the present invention is constructed such that the position of the bolt handle at which the trigger is released from its locked state corresponds to the position thereof at which a bullet can be loaded into or taken out of a barrel cartridge chamber by way of a receiver, the locked trigger can securely be released whenever the bullet is loaded or taken out.

While the invention has been described with reference to specific embodiments, the description is illustrating and is not to be construed as limiting the scope of the invention. Various modifications and changes may occur to those skilled in the art without departing from the spirit and scope of the invention as defined by the appended claims.

What is claimed is;

1. A locked trigger releasing device for releasing a trigger locked by a set-trigger mechanism widely applied to a gun which comprises at least a receiver, a bolt loosely inserted in said receiver, and a bolt handle for rotating and reciprocating said bolt so as to load a bullet and set in a fire-enabling state, wherein said locked trigger releasing device comprises:

an abutting portion formed on said bolt handle; and a release means comprising a pushing means for pushing said trigger responsive to rotational movement of said bolt handle to release said set-trigger mechanism, characterized in that said trigger locked by said set-trigger mechanism is released when said bolt handle is rotated up to a fire-disabling position, such that said pushing means contacts said abutting portion and said trigger is pushed to release said set-trigger mechanism.

2. A locked trigger releasing device as claimed in claim 1, wherein said abutting portion is formed with a guide means for receiving said release link, whereby said locked trigger is automatically released when said bolt is to be inserted.

3. A locked trigger releasing device as claimed in claim 1, wherein a rotated position of said bolt handle at which said abutting portion formed thereon abuts with said release link coincides with a position thereof at which loading or removal of a bullet is enabled by way of said receiver, whereby said locked trigger is securely released whenever said bolt is to be inserted.

4. A locked trigger releasing device as claimed in claim 1, wherein said pushing means comprises a release link which directly pushes said trigger responsive to the rotational movement of said bolt handle.

5. A locked trigger releasing device as claimed in claim 4, wherein said receiver is formed with a through-hole at the lower portion thereof, thereby to enable said release link to move upward and downward within said receiver.

6. A locked trigger releasing device as claimed in claim 4, wherein the upper end of said release link and said abutting portion are detachable from each other.

7. A locked trigger releasing device as claimed in claim 1, wherein said pushing means comprises a release link and a release lever attached to said release link, which is rotatably supported by a rotational shaft for holding a lower end portion of said release link at a certain distance from said rotational shaft.

8. A locked trigger releasing device as claimed in claim 7, wherein said release lever further comprises a spring means between said release link and said trigger, said spring means being pivotally supported by said rotational shaft for repulsively urging said release link upwardly.

9. A locked trigger releasing device as claimed in claim 7, wherein said release lever is formed with a projection at the lower portion thereof for pushing said trigger downward.

* * * * *